US009132325B2

(12) United States Patent
Whitlam

(10) Patent No.: US 9,132,325 B2
(45) Date of Patent: Sep. 15, 2015

(54) PUTTER HEAD

(71) Applicant: David Whitlam, San Marcos, CA (US)

(72) Inventor: David Whitlam, San Marcos, CA (US)

( * ) Notice: Subject to any disclaimer, the term of this patent is extended or adjusted under 35 U.S.C. 154(b) by 104 days.

(21) Appl. No.: 13/650,063

(22) Filed: Oct. 11, 2012

(65) Prior Publication Data

US 2014/0106902 A1 Apr. 17, 2014

(51) Int. Cl.

| | |
|---|---|
| ***A63B 69/36*** | (2006.01) |
| ***A63B 53/04*** | (2015.01) |
| *A63B 71/06* | (2006.01) |

(52) U.S. Cl.

CPC ..... *A63B 53/0487* (2013.01); *A63B 53/04* (2013.01); *A63B 2053/042* (2013.01); *A63B 2053/0425* (2013.01); *A63B 2053/0441* (2013.01); *A63B 2053/0491* (2013.01); *A63B 2071/0694* (2013.01)

(58) Field of Classification Search

CPC ..... A63B 53/0487; A63B 53/04; A63B 2053/0491; A63B 2053/0425; A63B 2053/0441; A63B 2053/0694; A63B 2053/042

USPC ..... 473/324–350, 287–292, 242–255

See application file for complete search history.

(56) References Cited

U.S. PATENT DOCUMENTS

| | | | | | |
|---|---|---|---|---|---|
| 4,121,832 | A * | 10/1978 | Ebbing | 473/335 |
| 5,460,377 | A * | 10/1995 | Schmidt et al. | 473/328 |
| 5,509,660 | A * | 4/1996 | Elmer | 473/288 |
| 6,238,303 | B1 * | 5/2001 | Fite | 473/342 |
| 6,264,571 | B1 * | 7/2001 | Lekavich | 473/340 |
| 6,663,497 | B2 * | 12/2003 | Cameron | 473/245 |
| 6,863,620 | B2 * | 3/2005 | Tucker, Sr. | 473/288 |
| 7,083,525 | B2 * | 8/2006 | Pond et al. | 473/251 |
| 7,121,958 | B2 * | 10/2006 | Cheng et al. | 473/345 |
| 7,278,926 | B2 * | 10/2007 | Frame | 473/329 |
| 7,566,276 | B2 * | 7/2009 | Billings | 473/251 |
| 7,575,525 | B2 * | 8/2009 | Matsunaga et al. | 473/342 |
| 7,980,963 | B2 * | 7/2011 | Rice et al. | 473/329 |
| 2003/0109323 | A1 * | 6/2003 | Edel | 473/226 |
| 2003/0216191 | A1 * | 11/2003 | Wright et al. | 473/288 |
| 2007/0111813 | A1 * | 5/2007 | Edel | 473/288 |
| 2010/0099510 | A1 * | 4/2010 | Bryant et al. | 473/251 |

* cited by examiner

*Primary Examiner* — Sebastiano Passaniti
(74) *Attorney, Agent, or Firm* — Donn K. Harms

(57) ABSTRACT

A golf club head having an aperture communicating between the face surface for ball striking and a rear of the head. The aperture is configured for cooperative engagement with a flange having a vertically disposed shoulder portion extending from a horizontally disposed base. A front surface of the flange having indicia thereon is viewable in a central portion of the face when the flange is engaged to the head, thereby providing viewable indicia for advertising, targeting the ball, and identifying ownership or a locale visited by the user.

15 Claims, 5 Drawing Sheets

PUTTER HEAD

This application claims priority to U.S. Provisional patent application No. 61/546,000 filed on Oct. 11, 2011, and incorporated in its entirety by this reference thereto.

BACKGROUND OF THE INVENTION

1. Field of the Invention

The present invention relates generally to golf clubs such as putters. More particularly, the device and method relate to a device and method for imparting indicia to the head of a golf club such as a putter concurrent with changing the weighting thereof if desired.

2. Prior Art

Golf clubs are often custom fitted, balanced and weighted to a user's physical dimensions, skill level and ability, as needed, for improved play. As such, golf club designs, especially putters, are continuously evolving. Putter's essentially consist of a hosel configured for receiving and connecting to the club shaft, a connection to a body or blade which has a face portion for striking the ball. The face of the blade may be provided at one or a plurality of different angles to the vertical and different weight distributions are intended to assure that the ball will move directly from the face of the putter upon impact with a desired top spin while avoiding side spin and ball skidding.

Putters are made from a variety of materials. Generally, putters are formed from metal by casting or machining. Others have areas of composite, plastic and wood. Weight distribution along the body or putter blade can influence overall play and thus effectiveness. Some putters concentrate weight along the lower edge, others along the upper edge and still other towards the center or ends of the putter.

In some circumstances, such as customizing a putter for a particular user, it is desirable to be able to vary the putter weight balance, and total weight to accommodate different conditions and different players. Additionally, many golfers prefer putters formed of different structural materials such as differing metals and composites which can adjust acceleration on impact and can dampen characteristics of the club on ball impact.

Further, golfers, golf courses, sports teams, manufacturers, and others alike often find it desirable to provide some marking or indicia as an identifier on their equipment. Such indicia identifiers may provide means for club or user identification such as viewable information concerning the nature of the impact characteristics of the club head. Further, such indicia may provide a visually viewable souvenir of a particular course or place or an advertisement to both the user and especially to third parties the user may wish to see the ad or indicia. Still further, in the case of school teams or country clubs and golf courses who may own and lend or rent clubs, the presence of an identifier on the club, discernable when viewed from a distance of a few feet, provides a means for preventing theft of equipment, since players are unlikely to abscond with clubs which bear identifiers of ownership other than their own. For similar reasons sponsors of golfers, tournaments and contests, place indicia upon golf clubs. However, for the reasons noted below, concerning the indicia being removed by wear, advertising sponsors may restrict their budget for such sponsoring and advertising since the indicia bearing their ad is rendered unattractive or illegible from use.

Such indicia as currently imparted to golf clubs is highly prone to easy marring or removal from the club head or blade. A primary cause of such marring, even when high adhesion inks are used, is due to the nature of the club head employment for striking a ball. Such impact and the easy displacement of most indicia which is imparted with ink or the like to the ball, over time, will render the indicia unattractive at best and unreadable at worst.

As such there is a continuing and unmet need for a golf club head and in particular a putter that allows a user to vary the weight and balance of the putter itself. Such a system and construction should concurrently provide a means for imparting intelligible indicia as an ownership identifier, advertisement, or souvenir to the putter or club in a position where it is viewable by third parties and cameras, such as on the face or rear surface of the putter head. In such a system or device, the indicia should be rendered easily imparted and preferably should be rendered substantially permanent and highly resistant to removal, or to being rendered illegible through marring and impacts during regular use of the club for golf play.

SUMMARY OF THE INVENTION

The device and method herein disclosed and described, provides a solution to the shortcomings in prior art and achieves the above noted goals through the provision of a golf club such as a putter, for instance, configurable with indicia employable as an ownership identifier, club and characteristic identifier, and/or advertisement thereon. Whether an advertisement, ownership identifier, or club identifier in singular or combination, the device and/or method herein renders the indicia in a manner viewable by third parties not holding the club during use, which is permanent and substantially unalterable by marring and use. This will encourage sales when purchased as a souvenir and will provide increased utility when the indicia is employed as an identifier of the club or the owner, or as a target for the ball.

The system and device herein in one favored mode employs a putter head having a removably engageable flange insert portion. The perimeter of a projecting portion of the flange insert is preferably configured for an engagement within a complimentary shaped void or cut-out portion in a central area of the head between the heel and toe. Such a void or cut-out is formed in the sole and employs a centrally located passage communicating between the face of the club and the rear for insertion of indicia readable from the face portion. In use the flange is preferable engaged with the formed central passage and secured to prevent removal and vibration on use using a screw or fastener, adhesive, a locking pin or other means for vibration-free securement as may be known in the art.

Utility is found employing the flange insert which includes indicia positioned upon a front surface, rear surface, or both as desired by a user. The indicia can be etched, screen printed, engraved, cut, or otherwise formed on either surface of the flange. Examples of such indicia include but are not limited to; advertising, owner identification, logos, or emblems.

In the case of advertising, it is particularly preferred that the central passage communicating between the face and the rear of the head and the engaging flange insert are standardized. This configuration will allow manufacturers to mass produce the device having heads employing engageable passages for indicia and to simply position the indicia on the flange element as needed, such as through conventional silk screening techniques. However, in other modes the flange insert can be customized for individual players through other means for imparting indicia such as engraving, cutting, etching, or the like. Particularly preferred are forms of indicia which are highly resistant to removal such as forming the metal of the flange to form the indicia visible on the club face.

In general, the front surface of the flange, when inserted into the putter head, aligns with the surface of the face of the club and defines the ball striking surface. The flange additionally extends to the rear of the club head along a cut-out region and along the bottom surface or sole of the club head. This will allow for indicia placement and club weight and balance adjustment concurrently. Additional utility is found in that varying the weight of the flange will provide a means to alter the balance and weight of the club as needed for accommodating different playing conditions and players. Further, the flange of the device and method herein, may include indicia indicating the mass or weight of the particular insert at hand, and/or in cases of advertising or souvenirs or mass or weight, the flanges may be from a kit or group having a plurality of such flanges each of which adapted with differing weight and/or with differing indicia characteristics thereon, and all configured to removably engage with the head.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

Further objectives of this invention will be brought out in the following part of the specification wherein detailed description is for the purpose of fully disclosing the invention without placing limitations thereon.

It is an object of the invention to provide a putter with a removably engageable flange component allowing a user to vary the weight and balance of the club.

It is an object of the invention to provide a putter with a means to position customized indicia on the face or rear surface of the club head, as desired for identification, advertisement or memorializing a visit to a particular course or event.

These together with other objects and advantages which become subsequently apparent reside in the details of the golf club indicia and weighting system and method herein as more fully hereinafter described and claimed, reference being had to the accompanying drawings forming a part thereof, wherein like numerals refer to like parts throughout.

BRIEF DESCRIPTION OF DRAWING FIGURES

DETAILED DESCRIPTION OF THE PREFERRED EMBODIMENTS OF THE INVENTION

Figure 1:
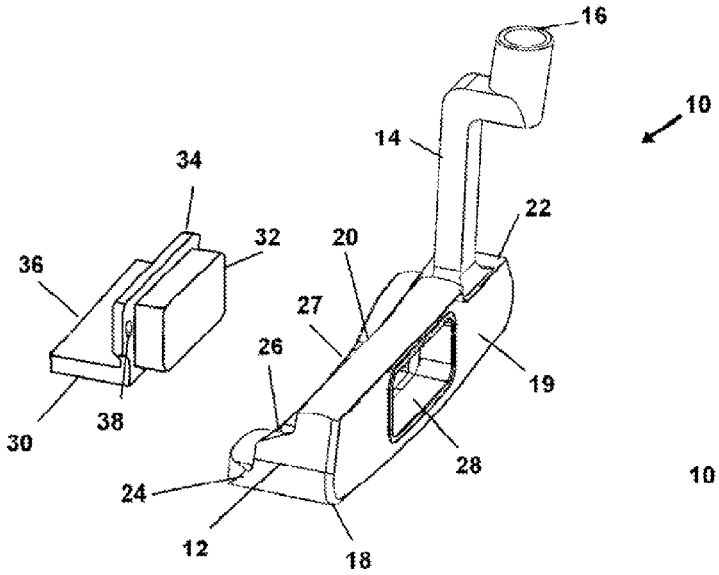
FIG. 1 shows an elevated view of the device depicting the insert which is configured to bear indicia providing an identifier as disengaged from the club head.

Now referring to drawings in FIGS. 1-18, wherein similar components are identified by like reference numerals, there is seen in FIG. 1 an elevated view showing the device 10. There is included a putter head 12 with a neck 14 portion connecting the head 12 to the hosel 16 for receiving a putter shaft (not shown). Hosel 16 is formed as a cylindrical tube, having a shaft receiving end that is square to the hosel centerline. Neck 14 normally has cross section between rectangular and circular.

Head 12 has a sole 18 which may be flat or slightly curved. A flat face 19 portion lies at an angle to a sole 18 which is conventionally substantially 90 degrees and defines the ball striking surface. Putter head 12 has a central region 20 with heel region 22 and toe region 24. The head 12 additionally includes a passage 28 substantially communicating through the central region 20 of the head 12 between the rear 26 of the head 12 to the face 19.

In the preferred mode, a trailing ledge extending from the rear 26 of the head 12 in a direction away from the face 19, is configured with a gap formed therein by a cut-out region 27 (FIG. 3) in the area of the central portion 20 of the head 12. The gap formed by the cut-out region 27 and the passage 28 are both configured for receiving cooperatively dimensioned portions of a flange 30 shown in FIGS. 1 and 4-5, for instance.

Figure 2:
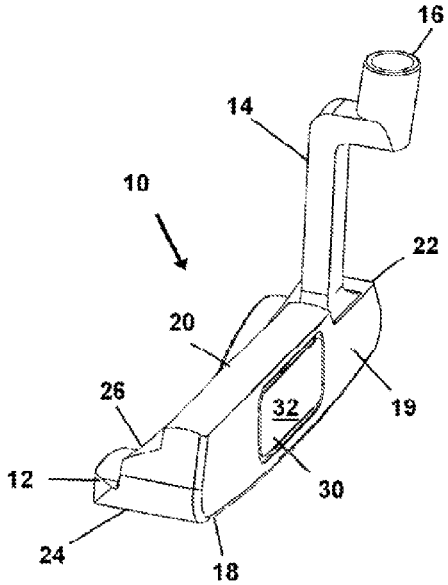
FIG. 2 shows the device in the as used mode with the flange insert in an engaged position within a centrally located passage between the face and rear of the club head.
Figure 3:
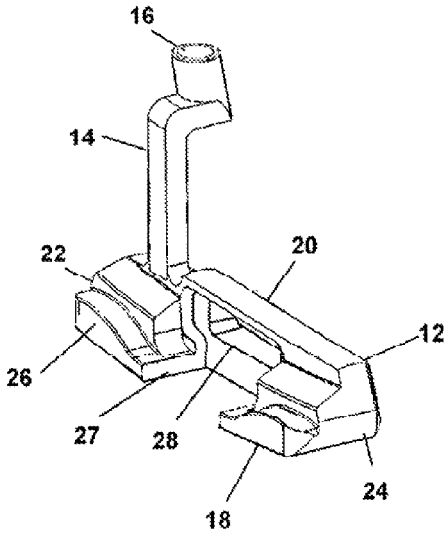
FIG. 3 is a rear elevated view of the device with the flange insert not shown detailing the sole cut-out portion and central passage.

The device 10, as shown in FIG. 1-3, may be configured with a removably engageable insert or flange 30 which may be engaged to the head 12 to an engaged position where it is operatively mounted, from a disengaged position.

In a preferred mode, the flange 30 has a projecting front surface 32 with a shoulder portion 34 and an elongated base portion 36 generally disposed at 90 degrees relative the front surface 32 portion. In use, the front surface 32 which communicates to the shoulder 34 of the flange 30 with a sidewall of the flange 30, is received into the cooperatively shaped central passage 28 of the head 12.

Figure 12:
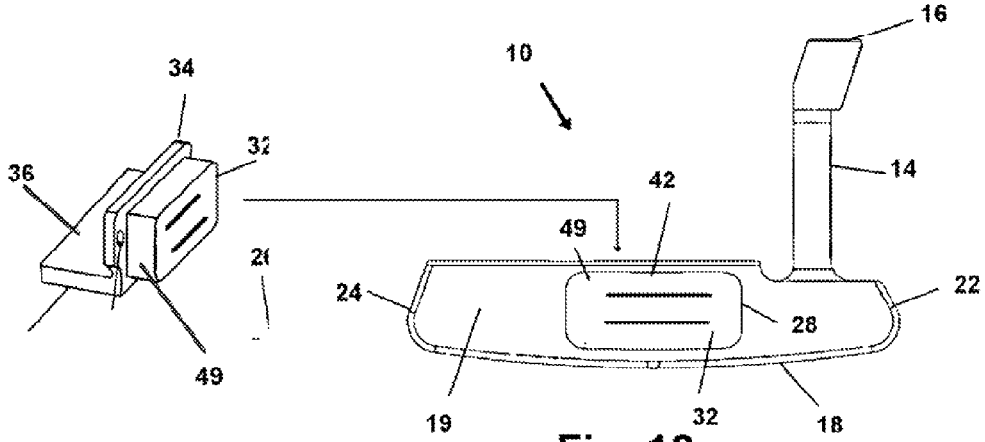
FIG. 12 depicts a mode of the device wherein the flange has targeting indicia positioned to provide a target for the ball when engaged to the head.
Figure 17:
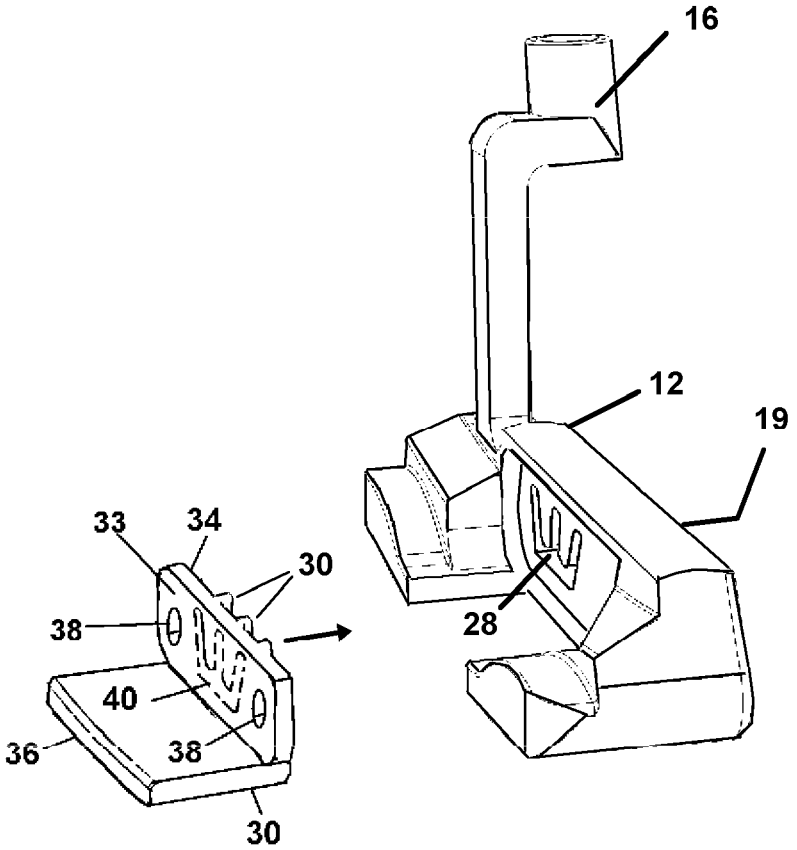
FIG. 17 shows the flange having a projecting indicia component engaging an aperture dimensioned to cooperatively engage the projecting indica providing the identifier or advertising to the face of the club.

Insertion to an engaged position may be as in FIG. 17 or FIG. 12, via insertion from the rear 26 of the head 12 by a sliding engagement toward the face 19. This positions the front surface 32 of the flange 30 flush with the face 19 of the head 12. Alternatively insertion to an engaged position may be as in FIG. 10, via insertion from the face 19 side toward the rear. As noted earlier, in the case of removably engageable flanges 30 and clubs with engageable configurations, the flanges 30 may be from a kit or group of having a plurality of such flanges 30 each with differing indicia, or adapted with differing weight, and all configured to removably engage to an engaged position on the head.

The base portion 36 projecting normal to the shoulder 34 of the flange 30 preferably seamlessly aligns with the gap formed by the cut-out region 27 (FIG. 3) of the head 12 within the central portion 20 of the head 12. When means for engagement of the flange 30 to the head 12 is a removable means for engagement, the shoulder 34 may additionally include apertures 38 adapted to receive screws, pins, or the like therethrough as means for removable engagement of the flange 30 to the head 12.

As can be seen in FIG. 2 the front surface 32 of the flange 30 in operative engagement to the head 12, via the central passage 28, is positioned flush or vertically inline with the face 19 such as to mate with the face 19 in the same vertical plane. The viewable identifier or advertising, in the form of indicia, formed by or placed on the front surface 32 of the flange 30, will thereby be positioned in the same plane as the face 19 of the head 12, and be viewable by third parties while the club is in use, or by cameras or the like. The indica may be imparted using stain, ink, or preferably anodizing the metal surface in a fashion rendering the indica permanent and unalterable. The flange 30 can be produced in mass quantity with varying indicia allowing users to simply replace the flange 30 as needed to display the desired indicia.

FIG. 3 shows a rear elevated view of the head 12 detailing the cut-out region 27 and central passage 28 for receiving the flange insert 30.

Figure 4:
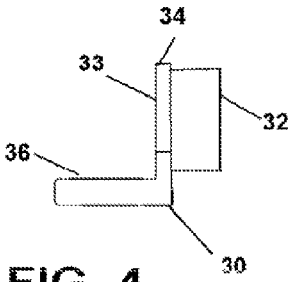
FIG. 4 is a side view of the flange insert.
Figure 5:
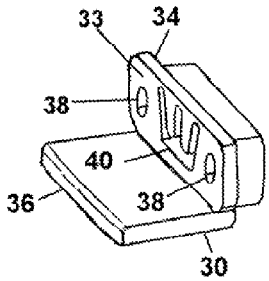
FIG. 5 is an elevated view of an additional mode of the flange insert with indicia imparted on the rear surface of the insert.

FIG. 4 and FIG. 5 show side and rear elevated views respectively of the flange insert 30. In another mode of the flange 30 as shown in FIG. 4 the rear surface 33 of the flange 30 employs indicia 40, such as engraving, carving, or etching. The engraved or carved indicia 40 typically extends from the rear surface 33 to substantially near the front surface 32. The depth and form of the engraved indicia 40 additionally provides a means to vary the weight of the flange 30 and therefor weight and balance of the putter head 12. This provides additional utility in that a user may employ a plurality of flange inserts 30 with different indicia 40 representing different weights as needed to tune the swing and striking characteristics of the club.

As mentioned, indicia may be employed on the front surface 32, rear surface 33, or both surfaces of the flange 30 as desired by a user for identification, advertisement, and specific weighting. When used by a player during tournament play that is televised, during close shots of the ball being struck by the club face, the indicia 40 on the front surface functions much like a billboard where it may advertise a sponsor of the player or tournament.

Figure 6:
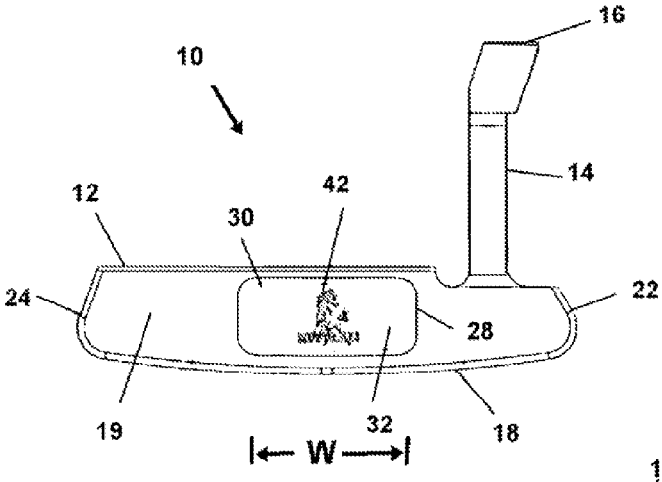
FIG. 6 shows a front view of a mode of the device in the as used mode with indicia employed on the front surface of the insert and therefor face of the putter head.

Shown in FIG. 6 is a particularly preferred mode of the device 10 in the as used mode showing a front view. Indicia 42 such as an emblem, logo, or text is screen printed, painted, etched or otherwise formed on the front surface 32 of the flange insert 30 therefor imparting the indicia 42 on the face 19 of the head 12. The width "W" of the front surface 32 of the flange 30 as inserted is preferably substantially the same width as a conventional regulation golf ball which is from 42.60 mm to 42.70 mm. In that fashion, from a visual standpoint, if the user is provided with a contrasting color of at least the face 19 of the insert and preferably the total flange 30, including the base portion 36 (FIG. 12) which when viewed against the contrasting color of the heel and toe sections of the putter, thereby providing the user looking down and holding the club to strike the ball, a means for alignment of their stroke as perpendicular to the ball, as well as a means to aim the ball by providing a sightline substantially the width of the ball, for the user to maintain the face of the head 12 perpendicular to the intended line of putt.

Figure 7:
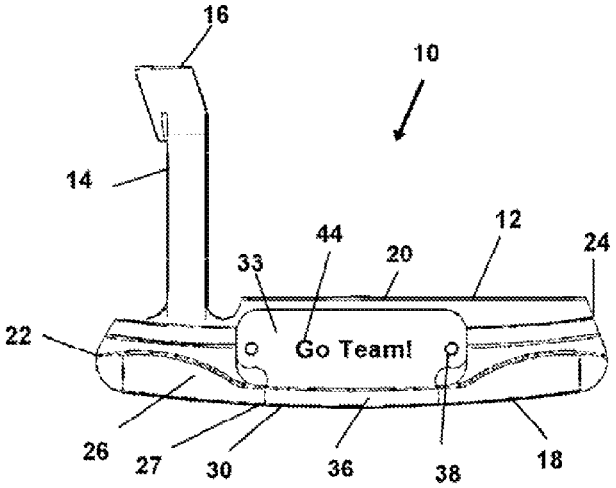
FIG. 7 is a rear view of an additional mode of the device with indicia employed on the rear surface of the flange such as via silk screening.

FIG. 7 shows an additionally preferred mode of the device 10 as viewed from the rear 26 of the head 12. As is seen, the flange 30 employs indicia 44, such as text, on the rear surface 33. It must be noted that this mode may be employed separately or in combination with that of FIG. 5 wherein indicia is additionally on the front surface 32 of the flange 30 and therefor face 19 of the head 12.

Figure 8:
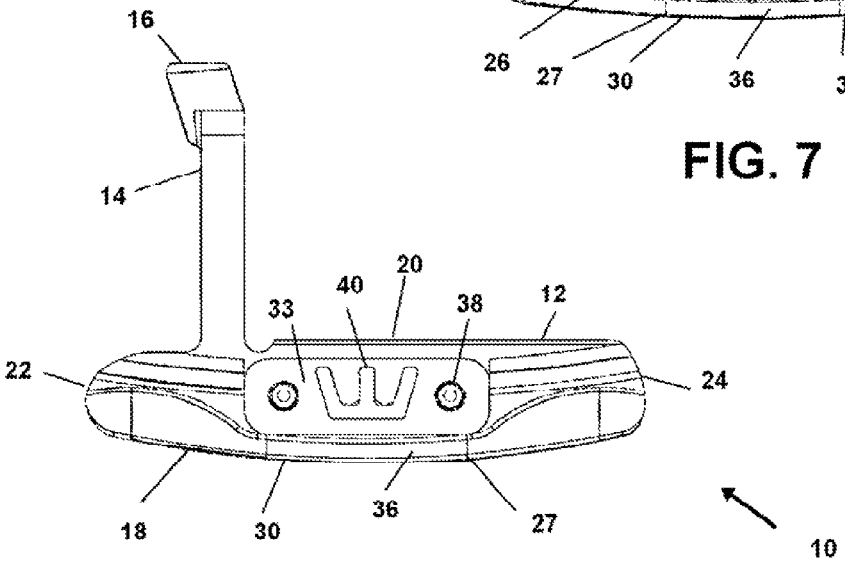
FIG. 8 is still a further mode of the device with indicia employed on the rear surface such as via engraving or etching.

Still further shown in FIG. 8 is a rear view of the device 10 in the as used mode wherein the rear surface 33 of the flange 30 employs an etched or engraved indicia 40 that extends toward the face 19. In all modes, the flange 30 is engaged to the head 12 via screws or pins extending through the apertures 38 to the head 12. However, the flange 30 may be permanently engaged such as via adhesives or other means known in the art.

Through standardization of the central passage 28 and flange 30, manufacturers can mass produce the flange 30 with advertisements, logos, or emblems of a particular golf course, team, or the like and sell them to the public much like golf ball markers used on the putting green. Users may alternatively employ personalized flange inserts 30 as needed for club identification or simply to show off a favorite team, quote, emblem, etc. Still further, the flange 30 having different weights can employ indicia indicating the exact mass or weight as needed for tuning performance characteristics of the putter.

Figure 9:
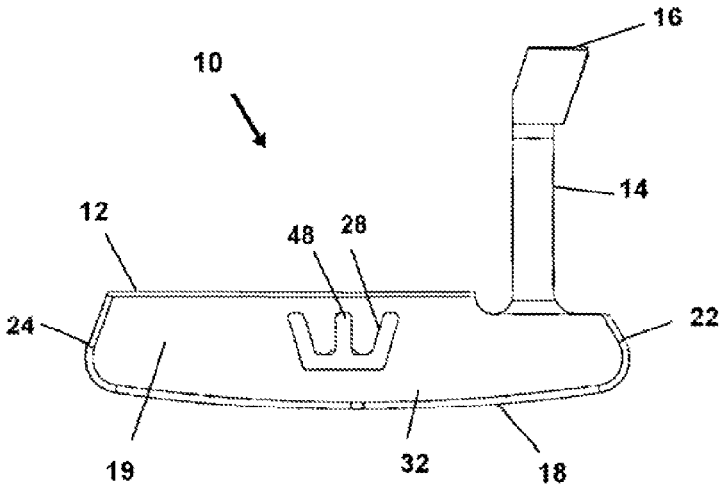
FIG. 9 depicts a particularly preferred mode of the device wherein the indicia is formed of colorized metal of a projection from the flange, and the passage is formed as a negative of the indicia fitting therein.

FIG. 9 depicts a particularly preferred mode of the device 10 wherein the indicia 48 is formed of colorized metal at least on the face of a projection 49 from the flange 30. The central passage 28 is formed in a shape to surround the form of the indicia 48 formed by the projection 49, fitting therein. In this mode of the device, the indicia 48 is formed of the metal forming the flange 30 which is colorized in conventional fashion thereby rendering colorized indicia on the club head which will hold up to the impact and abrasion of playing the game.

Figure 10:
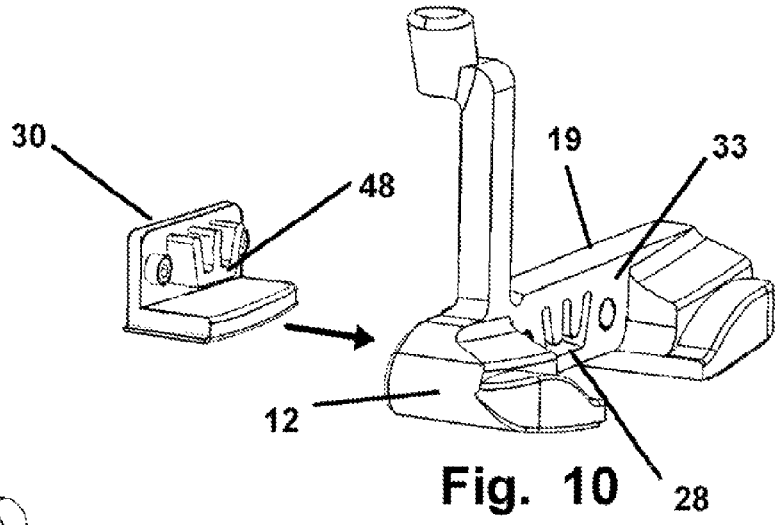
FIG. 10 shows another preferred mode of the device wherein the flange slidably engages from the face and has projecting indicia which engages within a complimentary aperture formed in the head.

FIG. 10 shows another preferred mode of the device 10 wherein the flange 30 slidably engages from the face 19 side of the head 12. The flange 30 as shown has projecting indicia 48 which engages within a complimentary aperture or central passage 28 formed in the head and communicating to the rear surface 33.

Figure 11:
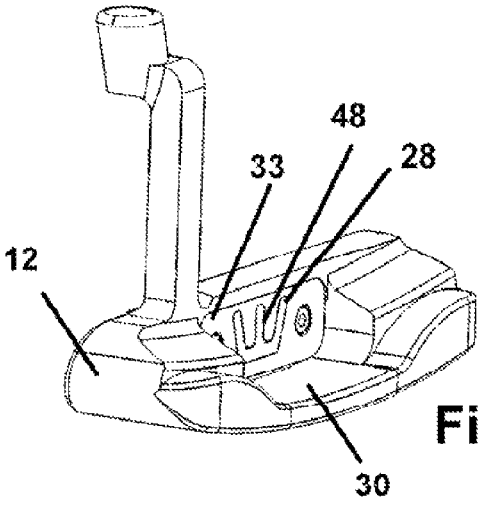
FIG. 11 depicts the assembled mode of the device of FIG. 10 showing the indicia engaged within the complimentary shaped aperture.

FIG. 11 depicts the assembled mode of the device 10 of FIG. 10 showing the projecting indicia 48 engaged within the complimentary shaped central passage 28. The leading edge of the indicia 38 can be colorized for instance if the flange 30 is formed of aluminum or other metal it can be silkscreened or colorized through immersion in a solution adapted to impart a color into the pores of the metallic surface. For instance coloring the indicia 48 shown as a "W" in red, which would then be surrounded by the color of the metal of the rear surface 33 of the club head 12 such as stainless steel. While rendered as a three dimensional projecting "W" in FIG. 10, the indicia 48 can be any shape which may be cut to slide into a complimentary shaped central passage 28 in the club head such as a company or golf club logo, another letter, or a cartoon character or the like.

FIG. 12 depicts a mode of the device 10 wherein the flange 30 has indicia 48 placed thereon upon the front surface 32. In this mode, the indicia 48 is for targeting in a hit of the golf ball by the device 10 and can be changed by employing a different flange 29 having differing indicia 48 positioned to provide a target for hitting the ball upon. The indicia 48 is preferably colorized to render it easily discerned.

Figure 13:
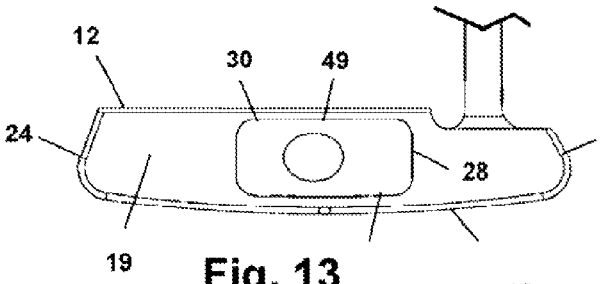
FIGS. 13-15 depict other modes of targeting indicia that may be employed.
Figure 14:
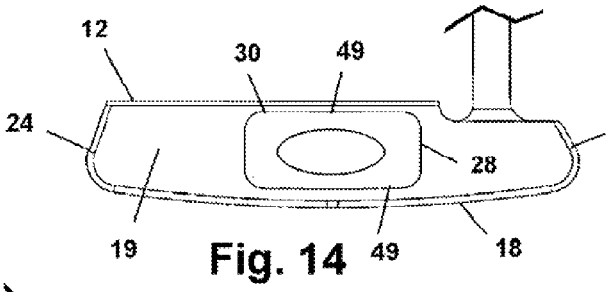
Figure 15:
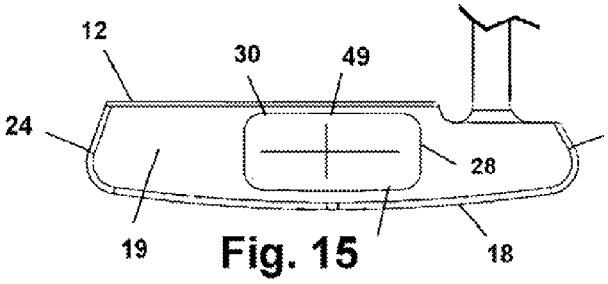

FIGS. 13, 14, and 15 depict other modes of targeting indicia 48 showing a circle, oval, and cross-hairs respectively. However, this indicia so depicted should in no way be considered limiting in that the user may choose any indicia 48 that may be rendered to the proper surface of the flange 29. In this mode, as in that of FIG. 6, the base portion 36 may be dyed or colorized or formed of material which is different in color than the surrounding head. This as noted provides a means to align the face of the head perpendicular to the line of the ball.

Figure 16:
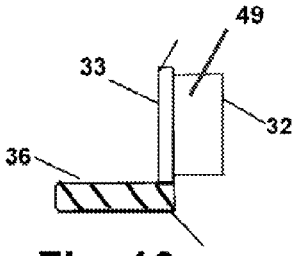
FIG. 16 depicts the flange formed of a plurality of materials of differing densities as a means to adjust one or both of the center of gravity of the head and the force of impact against a ball.

FIG. 16 depicts a mode of the flange 30 of the device which may be formed of a single material density, or a plurality of materials of differing densities. So formed, the flange 30 may be formed in materials of density as a means to adjust one or both of the center of gravity of the head, and the force of impact against a ball.

The flange 30 as noted can be made from one or a combination of materials to provide a means to effect the Moment on Impact (MOI) of the club for individual users. By making the head 12 of different material density than that of the flange 30 the resulting club can be fine tuned to user requirements. Where a lighter density material makes up the flange 30 the higher the MOI. Conversely, the heavier the flange 30 density, the lower the MOI. Flanges 30 formed of one or a combination of aluminum and plastic are preferred where the head 12 is stainless steel or titanium. However, if a user wanted a heavy weight head 12 then employing one or a combination of tungsten or stainless steel weight would also work well.

Another preferred mode of the device 10 employs aluminum for the material forming at least the projection 49 as a means to form a sweet spot for ball impact with a lower density than the stainless steel or tungsten head 12 allowing for a better follow through on a stroke and as a means to adjust the playability of the club to a user since by forming the device in this fashion, substantially 85% of the club's weight is positioned out to the outer area of the putter from the projection 49 and flange 30.

For example, a symmetrical 350 g head 12 using the light weight flange 30 is divided in thirds with 116 g per ⅓. By replacing almost all of the center section with the flange 30 and leaving just 15-20 grams worth of connecting material, the appearance between the non insert head 12 to the flange 30 inserted putter, is not noticeable but the weight is distributed more to the outer edges of the outer 3rd sections. This provides a means to assemble a traditional looking putter but adjusted with more heel toe weighting.

FIG. 17 shows the flange 30 having a projecting indicia formed by the face 19 of the flange 30 which is recessed around the perimeter of the design forming the face 19. The face 19 having a perimeter forming the projecting indicia, engages a complimentary configured passage 28. The flange 30 is secured to the head 12, and the projecting face 19 shown as indicia in the form of a logo "W" is clearly visible from the surrounding face 19 of the head 12 to which it is engaged. Anodizing the projecting face 19 a color different from the face 19 allows it to clearly stand out and be discernable from a distance. This mode of the device 10 provides a permanent identifier formed by the indica viewable from the face 19 which would work well for marking ownership of the club, or for long term advertising since it will not easily be rendered illegible.

Figure 18:
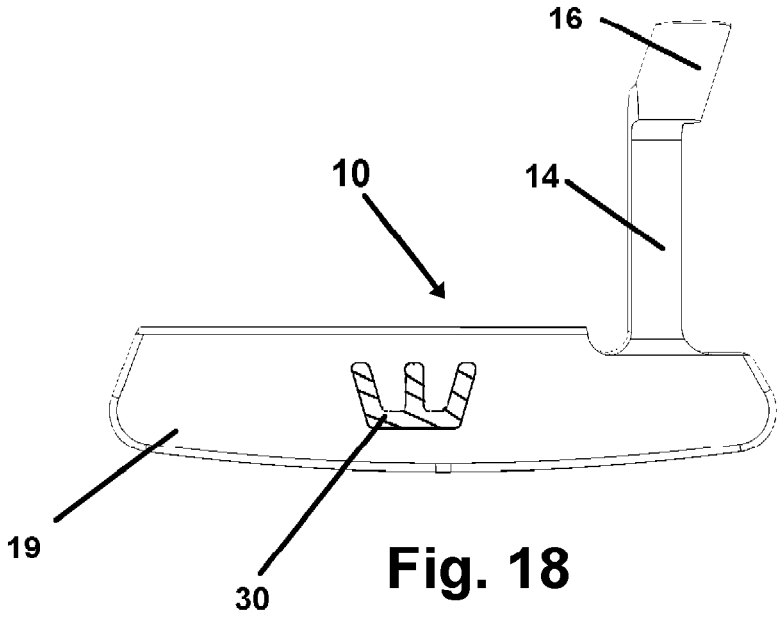
FIG. 18 depicts the device of FIG. 17 showing the indicia provided by the front face of the flange which projects forward and is anodized or otherwise colored different from the face of the head.

FIG. 18 depicts the device 10 of FIG. 17 showing the identifier for the club provided by the indica on the front face 19 of the flange 30 projecting through the passage 28 and flush with the front face 19 of the head 12.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed:

1. A golf club head comprising:

a head for a golf club, said head configured at a heel end for engagement to a shaft, and having a toe end opposite said heel end;

said head having a face surface for striking a ball and a rear surface opposite said face surface and a sole surface for positioning adjacent to the surface of play;

an aperture communicating through said head between said rear surface and said face surface;

a flange having a vertically disposed shoulder portion extending from a horizontally disposed base;

a front surface of said flange having an area defined by a sidewall communicating between said front surface and said shoulder portion;

said sidewall shaped in a complimentary configuration to an interior surface defining said aperture;

said flange positionable between a disengaged position from said head to an engaged position with said head wherein said sidewall communicates in a contiguous positioning with said interior surface of said aperture;

said front surface positioned within a perimeter edge of said aperture at a communication with said face surface, when said flange is in said engaged position;

indicia defined by said perimeter edge of said aperture, whereby, said indicia is viewable within said perimeter edge when said flange is positioned in either of said disengaged or said engaged position;

all or a portion of said front surface of said flange being anodized metal in a first color;

said face surface of said head having a second color contrasting with said first color;

said indicia defined by said perimeter edge surrounded by said second color on said face surface; and said aperture communicating with said face at said perimeter edge defining said indicia rendering said indicia permanent and substantially tamper proof, whereby said indicia may function as a permanent identifier, said identifier being one of an origination locale of said flange, or an identifying mark of ownership.

2. The golf club head of claim 1 additionally comprising:

said flange being from a group of flanges, each having said sidewall shaped in a complimentary configuration to said interior surface defining said aperture;

each flange of said group of flanges having secondary indicia concerning a locale imparted upon said front surface thereof;

means for removable engagement of each said flange to said engaged position; and whereby a user can choose and engage any of said group of flanges with said head, and thereby additionally define said indicia defined by said perimeter edge, with said secondary indica positioned within said perimeter edge concerning said locale thereon, as a viewable souvenir of a visit to said locale.

3. The golf club head of claim 1, additionally comprising:

said face surface of said flange colorized in a contrasting said second color to said first color upon said front face of said head; and wherein said perimeter edge and said second color of said colorized face both define said indicia.

4. The golf club head of claim 1 additionally comprising:

said flange slidably engageable in a direction toward said face surface of said head, through said head, to said engaged position from said disengaged position in a direction away from said rear surface of said head.

5. The golf club head of claim 1 additionally comprising:

said flange slidably engageable in a direction toward said rear surface of said head, through said head, to said engaged position from a disengaged position in a direction away from said face surface of said head.

6. A golf club head comprising:

a head for a golf club, said head configured at a heel end for engagement to a shaft, and having a toe end opposite said heel end;

said head having a face surface for striking a ball and a rear surface opposite said face surface and a sole surface for positioning adjacent to the surface of play;

an aperture communicating through said head between said rear surface and said face surface;

a flange having a vertically disposed shoulder portion extending from a horizontally disposed base;

a front surface of said flange having an area defined by a sidewall communicating between said front surface and said shoulder portion;

said sidewall shaped in a complimentary configuration to an interior surface defining said aperture;

said flange positionable between a disengaged position from said head to an engaged position with said head wherein said sidewall communicates in a contiguous positioning with said interior surface of said aperture;

said front surface positioned within a perimeter edge of said aperture at a communication with said face surface, when said flange is in said engaged position;

indicia defined by said perimeter edge of said aperture, whereby, said indicia is viewable within said perimeter edge when said flange is positioned in either of said disengaged or said engaged position;

all or a portion of said front surface of said flange being rendered in at least a first color;

said face surface of said head having a second color contrasting with said first color; and said indicia additionally defined by said first color of said front surface of said flange in a configuration providing a targeting point for a user to impact a golf ball during a stroke.

7. The golf club head of claim 6, additionally comprising:

said flange being from a group of flanges, each having said sidewall shaped in a complimentary configuration to said interior surface defining said aperture;

means for removable engagement of said flange to said engaged position; and each flange of said group of flanges having said indicia additionally defined by said first color thereon, in different configurations of said targeting point, whereby a user can choose and engage any one said flange of said group of flanges with said head, and thereby position a chosen one of said different configurations of said targeting point for use by said user.

8. The golf club head of claim 7 additionally comprising:

said flange slidably engageable in a direction toward said face surface of said head, through said head, to said engaged position from said disengaged position in a direction away from said rear surface of said head.

9. The golf club head of claim 6 additionally comprising:

said flange slidably engageable in a direction toward said face surface of said head, through said head, to said engaged position from said disengaged position in a direction away from said rear surface of said head.

10. The golf club head of claim 6 additionally comprising:

said flange slidably engageable in a direction toward said rear surface of said head, through said head, to said engaged position from a disengaged position in a direction away from said face surface of said head.

11. A golf club head comprising:

a head for a golf club, said head configured at a heel end for engagement to a shaft, and having a toe end opposite said heel end;

said head having a face surface for striking a ball and a rear surface opposite said face surface and a sole surface for positioning adjacent to the surface of play;

an aperture communicating through said head between said rear surface and said face surface;

a flange having a vertically disposed shoulder portion extending from a horizontally disposed base;

a front surface of said flange having an area defined by a sidewall communicating between said front surface and said shoulder portion;

said sidewall shaped in a complimentary configuration to an interior surface defining said aperture;

said flange positionable between a disengaged position from said head to an engaged position with said head wherein said sidewall communicates in a contiguous positioning with said interior surface of said aperture;

said front surface positioned within a perimeter edge of said aperture at a communication with said face surface, when said flange is in said engaged position;

indicia defined by said perimeter edge of said aperture, whereby, said indicia is viewable within said perimeter edge when said flange is positioned in either of said disengaged or said engaged position;

said front surface of said flange having secondary indicia imparted thereon of a sponsor of a player or a tournament in which said player is competing;

said front surface colorized and forming a surrounding contrast to said indicia which is defined by both said perimeter edge of said aperture and said secondary indica located therein on said front face with said flange in said engaged position;

said indicia viewable during a striking of said ball, by cameras broadcasting electronic images of said player employing said golf club in a said tournament; and said front surface defining a billboard as a means for advertising when said electronic images include said face surface of said head during a strike of said ball by said player.

12. The golf club head of claim 11 additionally comprising:

said flange being from a group of flanges, each having said sidewall shaped in a complimentary configuration to said interior surface defining said aperture;

means for removable engagement of said flange to said engaged position; and each respective said flange of said group of flanges having different said secondary indicia imparted thereon regarding a different said sponsor; and whereby said player employing a said golf club having said head can choose and engage any respective individual said flange of said group of flanges with their respective said head, and thereby position said indicia concerning a respective said sponsor thereon viewable as a said billboard during a said tournament.

13. The golf club head of claim 11 additionally comprising:

said flange slidably engageable in a direction toward said face surface of said head, through said head, to said engaged position from said disengaged position in a direction away from said rear surface of said head.

14. The golf club head of claim 11 additionally comprising:

said flange slidably engageable in a direction toward said rear surface of said head, through said head, to said engaged position from a disengaged position in a direction away from said face surface of said head.

15. A golf club head comprising:

a head for a golf club, said head configured at a heel end for engagement to a shaft, and having a toe end opposite said heel end;

said head having a face surface for striking a ball and a rear surface opposite said face surface and a sole surface for positioning adjacent to the surface of play;

an aperture communicating through said head between said rear surface and said face surface;

a flange having a vertically disposed shoulder portion extending from a horizontally disposed base;

a front surface of said flange having an area defined by a sidewall communicating between said front surface and said shoulder portion;

said sidewall shaped in a complimentary configuration to an interior surface defining said aperture;

said flange positionable between a disengaged position from said head to an engaged position with said head wherein said sidewall communicates in a contiguous positioning with said interior surface of said aperture;

said front surface positioned within a perimeter edge of said aperture at a communication with said face surface, when said flange is in said engaged position;

indicia defined by said perimeter edge of said aperture, whereby, said indicia is viewable within said perimeter edge when said flange is positioned in either of said disengaged or said engaged position;

said perimeter edge upon said face surface being shaped as a logo; and a first color on said front surface of said flange colorizing an interior of said logo defined by said perimeter edge.

* * * * *